US009919543B2

(12) United States Patent
Mori

(10) Patent No.: US 9,919,543 B2
(45) Date of Patent: Mar. 20, 2018

(54) RECORDING APPARATUS

(71) Applicant: SEIKO EPSON CORPORATION, Tokyo (JP)

(72) Inventor: Kazunori Mori, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/430,811

(22) Filed: Feb. 13, 2017

(65) Prior Publication Data

US 2017/0246887 A1 Aug. 31, 2017

(30) Foreign Application Priority Data

Feb. 25, 2016 (JP) ..... 2016-033927

(51) Int. Cl.

| | |
|---|---|
| ***B41J 13/00*** | (2006.01) |
| ***B41J 29/17*** | (2006.01) |
| ***B41J 13/08*** | (2006.01) |
| ***B41J 11/00*** | (2006.01) |

(52) U.S. Cl.

CPC ..... *B41J 13/00* (2013.01); *B41J 11/007* (2013.01); *B41J 13/08* (2013.01); *B41J 29/17* (2013.01)

(58) Field of Classification Search

CPC . B41J 11/007; B41J 13/08; B41J 13/00; B41J 29/17; B41J 2002/1655

See application file for complete search history.

(56) References Cited

U.S. PATENT DOCUMENTS

| | | | | |
|---|---|---|---|---|
| 6,530,658 | B1 * | 3/2003 | Pham | B41J 11/007 347/104 |
| 2011/0242152 | A1 | 10/2011 | Takeda et al. | |
| 2014/0035996 | A1 * | 2/2014 | Gros Gras | B41J 2/1652 347/33 |
| 2014/0241499 | A1 | 8/2014 | Tsuchiya | |
| 2014/0292967 | A1 * | 10/2014 | Hobo | B41J 11/007 347/101 |
| 2017/0113476 | A1 | 4/2017 | Hara et al. | |

FOREIGN PATENT DOCUMENTS

| | | | |
|---|---|---|---|
| JP | 2006-198988 | A | 8/2006 |
| JP | 2008-284808 | A | 11/2008 |
| JP | 2011-212991 | A | 10/2011 |
| JP | 2014-161454 | A | 9/2014 |
| JP | 2017-077960 | A | 4/2017 |

* cited by examiner

*Primary Examiner* — Julian Huffman

(74) *Attorney, Agent, or Firm* — Global IP Counselors, LLP

(57) ABSTRACT

The apparatus includes a cleaning section that includes a cleaning material for cleaning a transportation belt, which transports a recording target medium, by contact with the transportation belt. The cleaning section is capable of switching between a contact state, in which the cleaning material is in contact with the transportation belt, and a non-contact state, in which the cleaning material is not in contact with the transportation belt. The cleaning section is capable of performing renewal operation. The renewal operation is operation of renewing a contact region of the cleaning material, that is, a region of contact with the transportation belt, from a region that has already been used to a region that has not been used yet.

10 Claims, 12 Drawing Sheets

RECORDING APPARATUS

CROSS REFERENCES TO RELATED APPLICATIONS

The entire disclosure of Japanese Patent Application No. 2016-033927, filed Feb. 25, 2016 is expressly incorporated by reference herein.

BACKGROUND

1. Technical Field

The present invention relates to a recording apparatus that performs recording on a medium.

2. Related Art

In a recording apparatus such as a printer, a structure of transporting a target object, that is, a recording target medium such as recording paper, by using a transportation belt is adopted in some cases. However, a transportation belt is sometimes contaminated with dust or fiber, etc. originating from a recording target medium and having settled thereon, or with ink, etc. that is an example of liquid. If such contaminants transfer onto a recording target medium, it might make the quality of recording low. In particular, when recording is performed on both sides of a sheet of paper, there is a high risk of adhesion, to a transportation belt during recording on the back, of ink that was applied during recording on the front.

To solve this problem, a structure that includes a means for cleaning a transportation belt has been proposed in related art. For example, such a structure is disclosed in JP-A-2004-161454. An ink-jet recording apparatus disclosed in JP-A-2004-161454 includes a cleaning blade and a cleaning web. The cleaning blade is brought into contact with the transportation belt, and, in a contact state, scrapes off ink or paper dust, etc. that is on the surface of the belt. The cleaning web is brought into contact with the transportation belt, and, in a contact state, wipes the surface of the belt. The cleaning web is in the form of a roll on a web shaft. Driven by a motor, the cleaning web is taken up onto another shaft.

How unclean a transportation belt is varies from one to another depending on the state of use of an apparatus. However, in a recording apparatus according to related art, cleaning control is performed always in the same way regardless of how unclean a transportation belt is. This results in wasteful consumption of a cleaning material (cleaning web in JP-A-2004-161454).

SUMMARY

An advantage of some aspects of the invention is to reduce the consumption of a cleaning material and extend product service life or reduce the frequency of cleaning material replacement by performing proper cleaning control corresponding to the state of a transportation belt.

A recording apparatus according to a first mode of the invention comprises: a recording section that performs recording on a recording target medium; a transportation belt that transports the recording target medium to a recording area where the recording is performed by the recording section; a cleaning section that includes a cleaning material for cleaning the transportation belt by contact with the transportation belt and is capable of switching between a contact state, in which the cleaning material is in contact with the transportation belt, and a non-contact state, in which the cleaning material is not in contact with the transportation belt, and is capable of performing renewal operation, the renewal operation being operation of renewing a contact region of the cleaning material from a region that has already been used to a region that has not been used yet, the contact region being a region of contact with the transportation belt; and a control section that controls the cleaning section, wherein the control section is capable of performing first cleaning control, in which the renewal operation is not performed during the cleaning of the transportation belt, and second cleaning control, in which the renewal operation is performed during the cleaning of the transportation belt.

In this mode, the control section is capable of performing first cleaning control, in which the renewal operation is not performed during the cleaning of the transportation belt, and second cleaning control, in which the renewal operation is performed during the cleaning of the transportation belt. Therefore, in the first cleaning control, it is possible to avoid wasteful consumption of the cleaning material. In addition, it is possible to enhance the effects of cleaning the transportation belt in the second cleaning control. That is, it is possible to reduce the consumption of the cleaning material and extend product service life or reduce the frequency of the replacement of the cleaning material by performing proper cleaning control corresponding to the state of the transportation belt.

A second mode of the invention is that, in the first mode, the control section executes the first cleaning control in response to an event that occurs at timing that has been determined in advance and executes the second cleaning control in response to an event that occurs at non-periodic timing.

Assuming that the recording section is a liquid ejection head that ejects liquid, liquid on the transportation belt after the lapse of time since the last cleaning is high in viscosity due to moisture evaporation in many cases. In such a case, that is, if a predetermined event has occurred, it is possible to remove high-viscosity liquid by means of a part of the cleaning material. That is, it is possible to select the first cleaning control, thereby avoiding wasteful consumption of the cleaning material.

In contrast, if the time that has elapsed since the ejection of liquid from the recording head is short, that is, after an event that occurs non-periodically (e.g., paper jam), the viscosity of liquid on the transportation belt is low due to a small amount of moisture evaporation in many cases. In such a case, it is possible to remove low-viscosity liquid effectively by selecting the second cleaning control.

A third mode of the invention is that, in the first or second mode, the control section performs the renewal operation non-continuously either before or after, or both, the execution of the first cleaning control.

In this mode, since the control section performs the renewal operation non-continuously either before or after, or both, the execution of the first cleaning control, the region of contact with the transportation belt in the cleaning material has been updated to a region that has not been used yet when the first cleaning control is executed. This ensures effective cleaning in the first cleaning control. Moreover, since the renewal operation is non-continuous, it is possible to minimize the consumption of the cleaning material.

A fourth mode of the invention is that, in the first or second mode, the control section performs the renewal operation non-continuously before the execution of the first cleaning control and does not perform the renewal operation before the execution of the second cleaning control.

In this mode, since the control section performs the renewal operation non-continuously before the execution of the first cleaning control, the region of contact with the transportation belt in the cleaning material has been updated to a region that has not been used yet when the first cleaning control is executed. This ensures effective cleaning in the first cleaning control. Moreover, since the renewal operation is non-continuous, it is possible to minimize the consumption of the cleaning material. Furthermore, in a case of the second cleaning control, the renewal operation is performed continuously during cleaning operation and, therefore, it is possible to avoid wasteful consumption of the cleaning material by not performing unnecessary renewal operation before the execution.

A fifth mode of the invention is that, in any of the first to fourth modes, the control section executes the second cleaning control upon detection of a jam of the medium. In this mode, since the control section executes the second cleaning control upon detection of a jam of the medium, assuming that the recording section is a liquid ejection head that ejects liquid, it is possible to avoid the transfer of liquid onto the recording target medium transported next by removing the liquid on the transportation belt.

A sixth mode of the invention is that, in the fifth mode, the control section finds an adhesion area where liquid having been ejected from the recording section has adhered onto the transportation belt on a basis of medium jam detection information; and the renewal operation in the second cleaning control is performed from a state in which the cleaning material is in contact either at a start position of the adhesion area or in front of the start position of the adhesion area.

In this mode, since the control section finds an adhesion area where liquid having been ejected from the recording section has adhered onto the transportation belt on a basis of medium jam detection information, and since the renewal operation in the second cleaning control is performed from a state in which the cleaning material is in contact either at a start position of the adhesion area or in front of the start position of the adhesion area, it is possible to avoid the cleaning material from being renewed for an area that is not so much stained with liquid on the transportation belt, or to minimize the renewal operation, thereby avoiding wasteful consumption of the cleaning material.

A seventh mode of the invention is that, in any of the first to sixth modes, the control section sets contact pressure at which the cleaning material is in contact with the transportation belt in the first cleaning control to be higher than contact pressure at which the cleaning material is in contact with the transportation belt in the second cleaning control.

In this mode, since the control section sets contact pressure at which the cleaning material is in contact with the transportation belt in the first cleaning control to be higher than contact pressure at which the cleaning material is in contact with the transportation belt in the second cleaning control, it is possible to compensate for a decrease in cleaning performance due to the non-renewal of the cleaning material, thereby improving cleaning effects in the first cleaning operation.

An eighth mode of the invention is that, in any of the first to seventh modes, the cleaning material is a cleaning sheet that is in a form of a sheet roll and is reeled out from the sheet roll to be taken up onto a reeling shaft; in the first cleaning control and the second cleaning control, the control section drives the transportation belt; and the operation of renewing the cleaning material is operation of rotating the sheet roll. In this mode, it is possible to perform the operation of renewing the cleaning material easily with a simple structure.

A ninth mode of the invention is that, in the eighth mode, as the operation of renewing the cleaning material in the second cleaning control, the control section causes the cleaning sheet to be moved in a direction that is opposite of a direction of movement of the transportation belt.

In this mode, the control section causes the cleaning sheet to be moved in a direction that is opposite of a direction of movement of the transportation belt as the operation of renewing the cleaning material in the second cleaning control. The movement in the opposite direction enhances cleaning effects in the second cleaning control.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, an exemplary embodiment of the invention will now be explained. The scope of the invention is not limited to the embodiment described below. The invention may be modified in various ways within the scope of the recitation of appended claims. The description of the embodiment below should be construed on the basis of understanding that such a variety of modifications are also within the scope of the invention.

Figure 1:
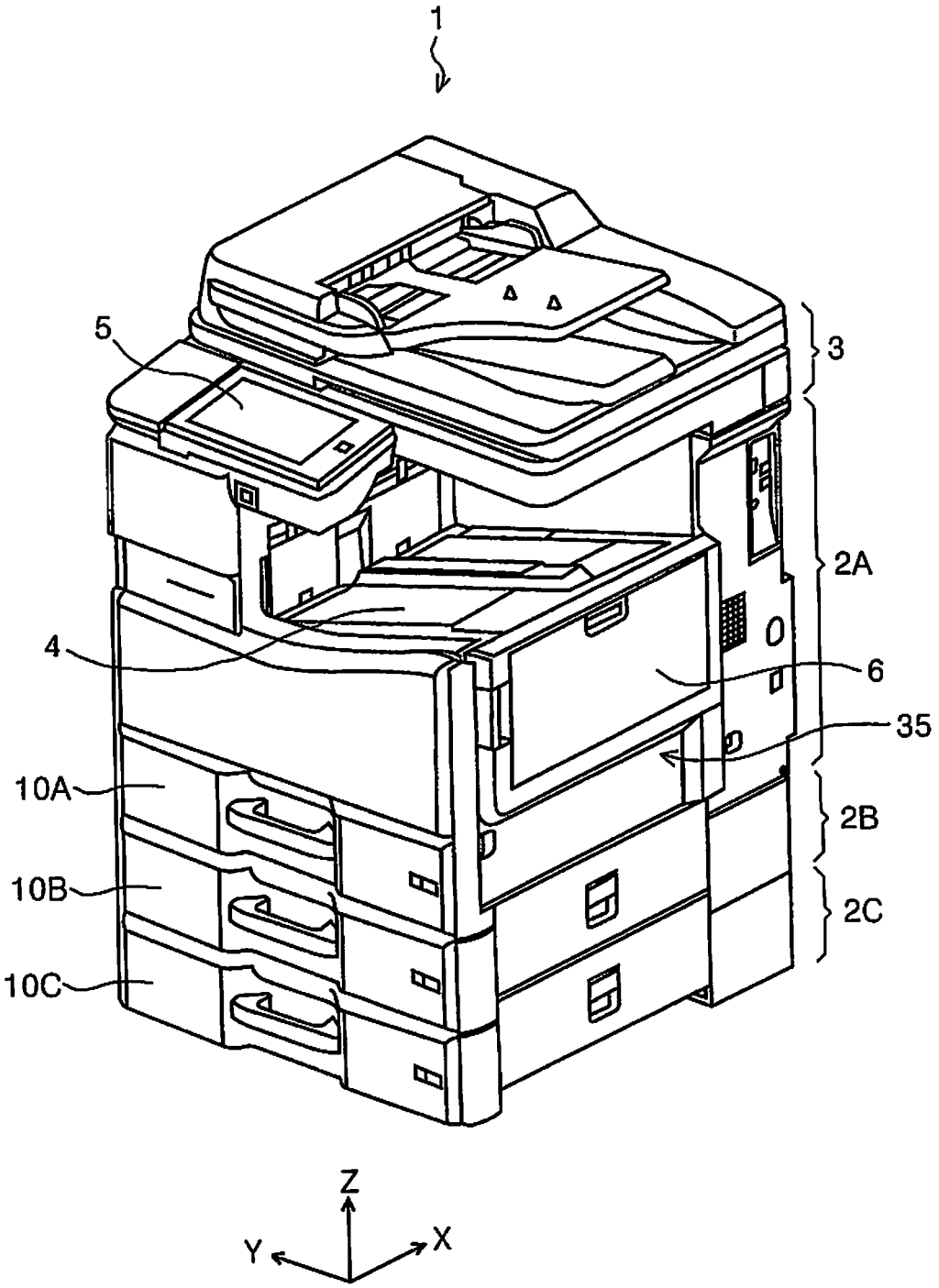
FIG. 1 is a perspective view of the appearance of an ink-jet printer according to an exemplary embodiment of the invention.
Figure 2:
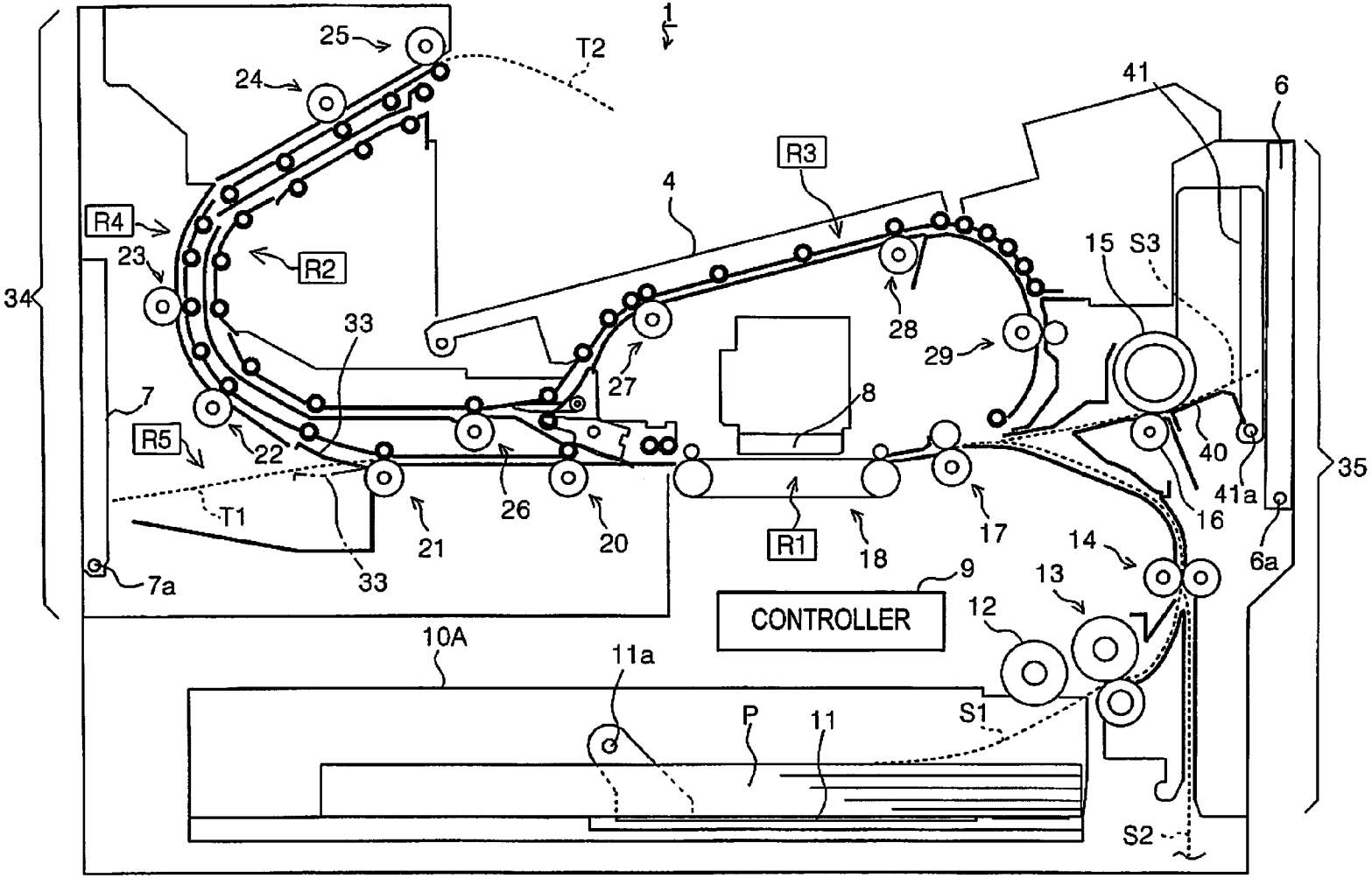
FIG. 2 is a side sectional view of the paper transportation paths of the ink-jet printer substantially in their entirety.
Figure 3:
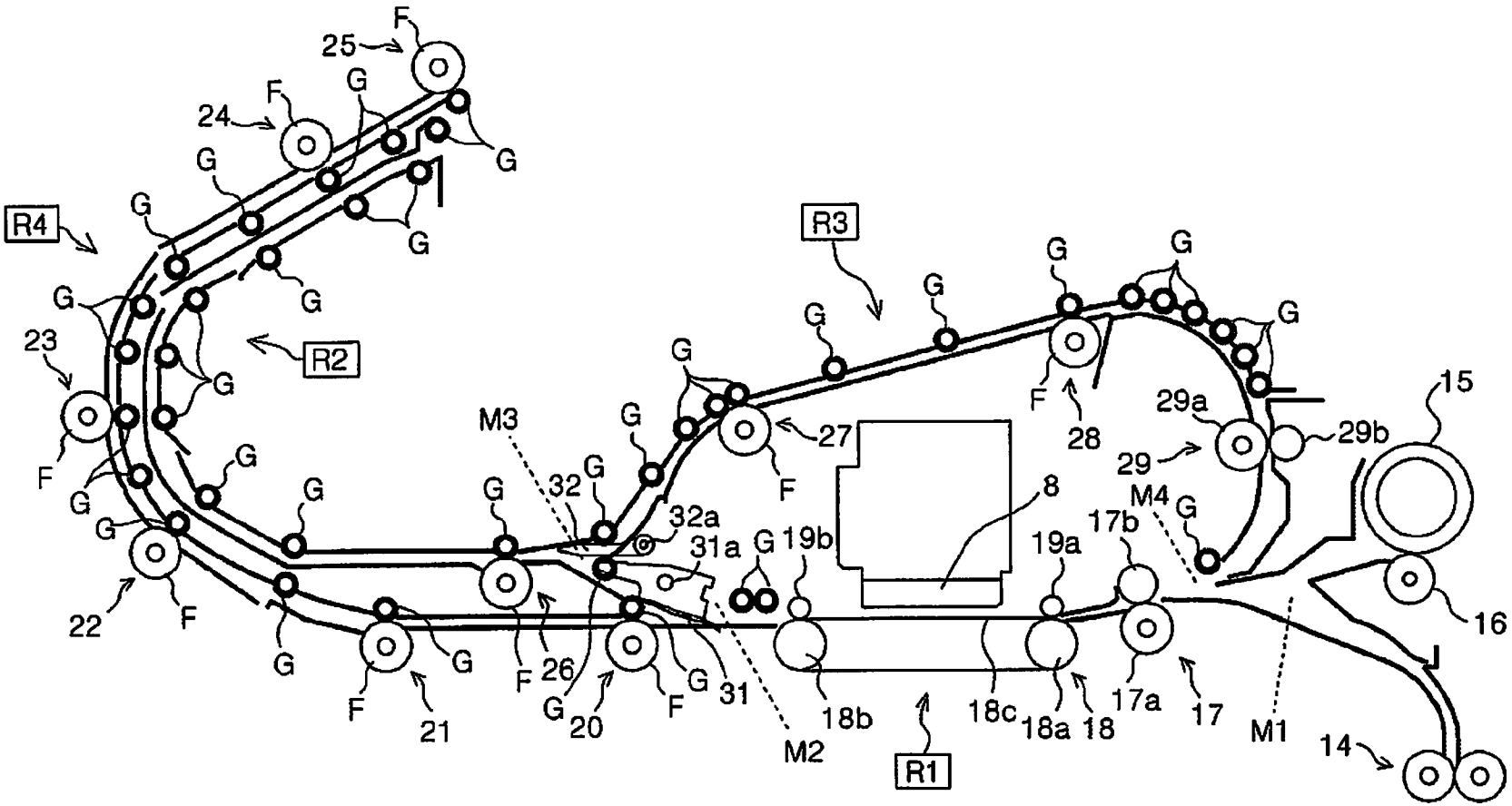
FIG. 3 is a side sectional view of some partial areas of the paper transportation paths of the ink-jet printer.
Figure 9:
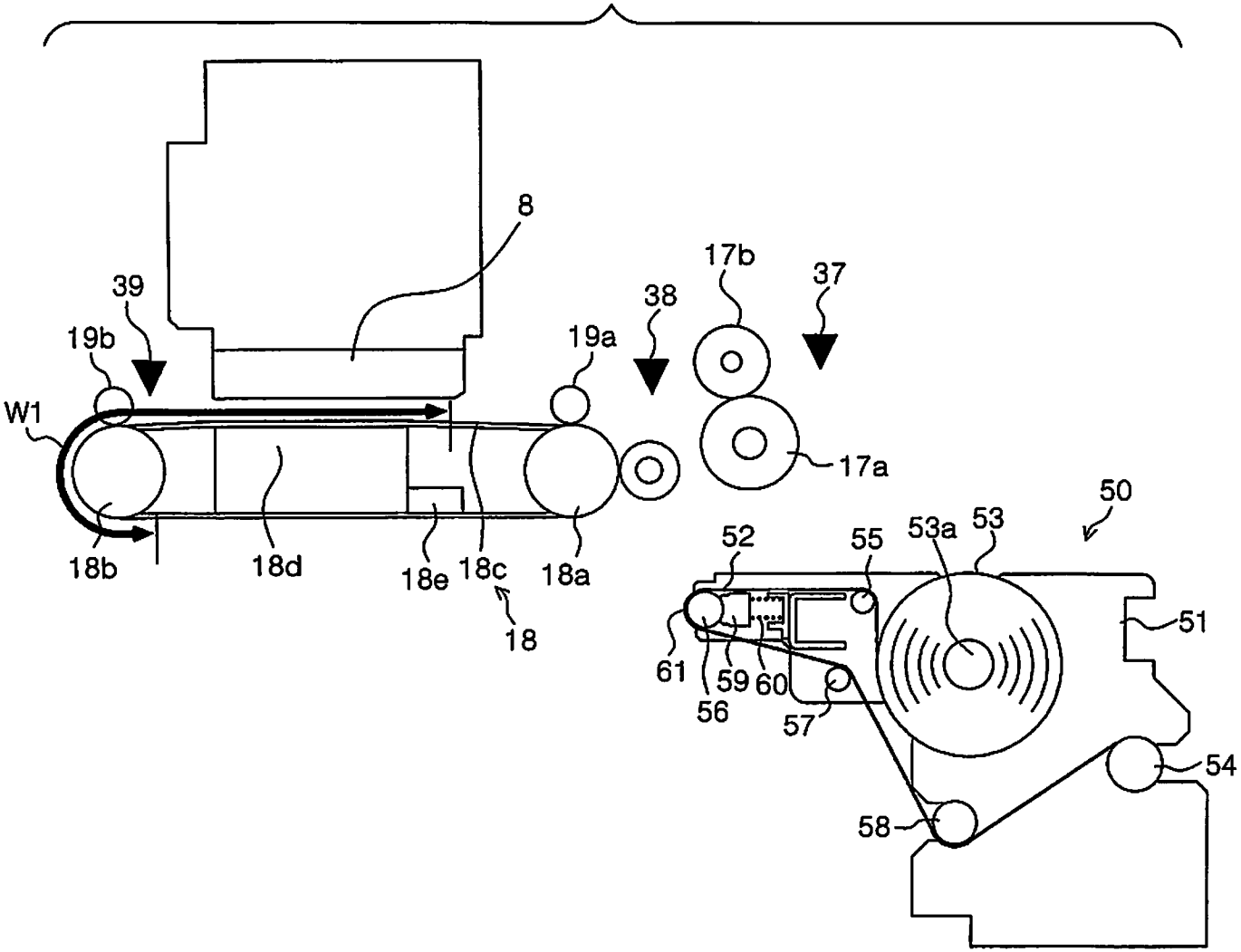
FIG. 9 is a side view of the belt unit and the cleaning unit.
Figure 10:
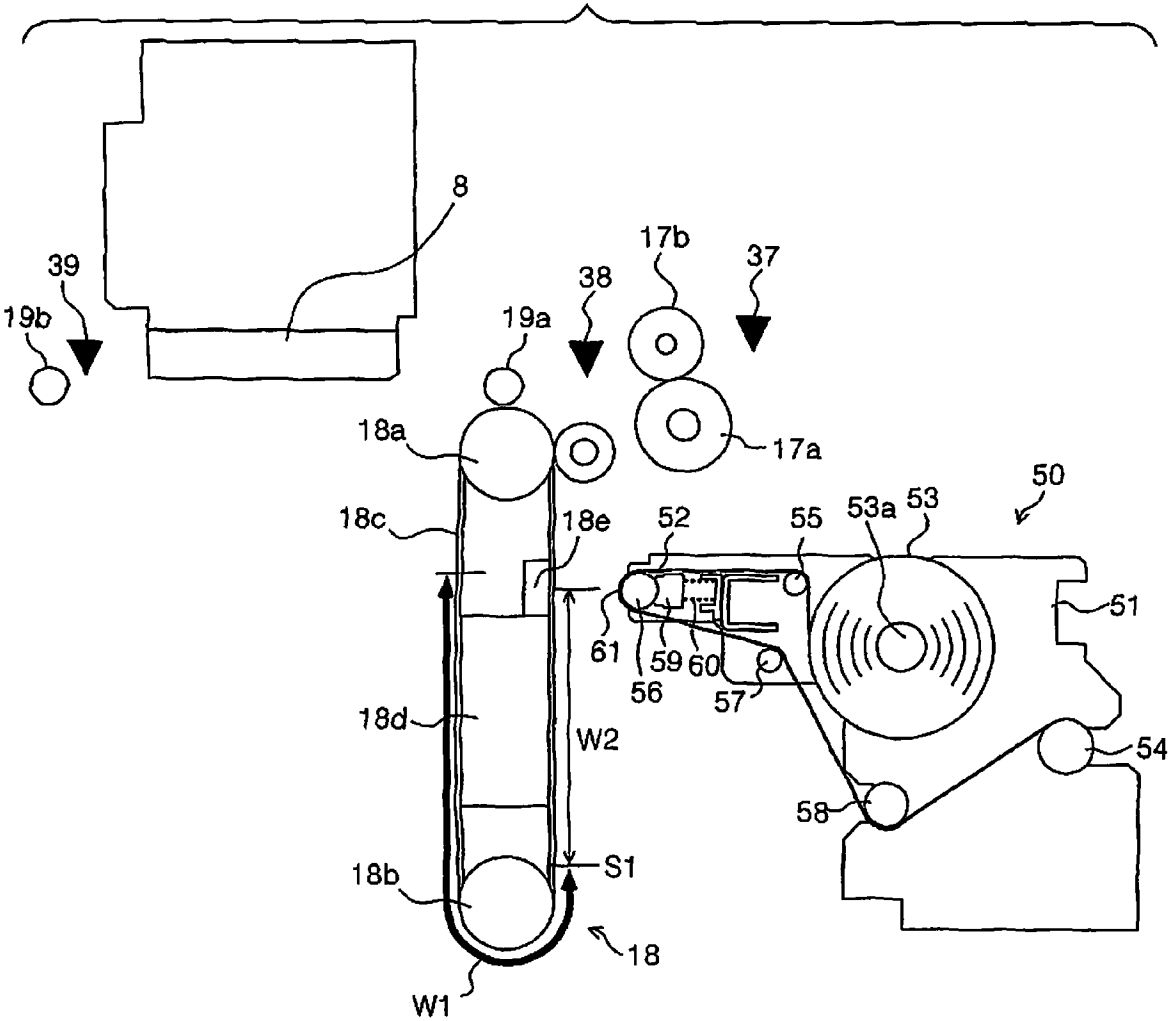
FIG. 10 is a side view of the belt unit and the cleaning unit.
Figure 11:
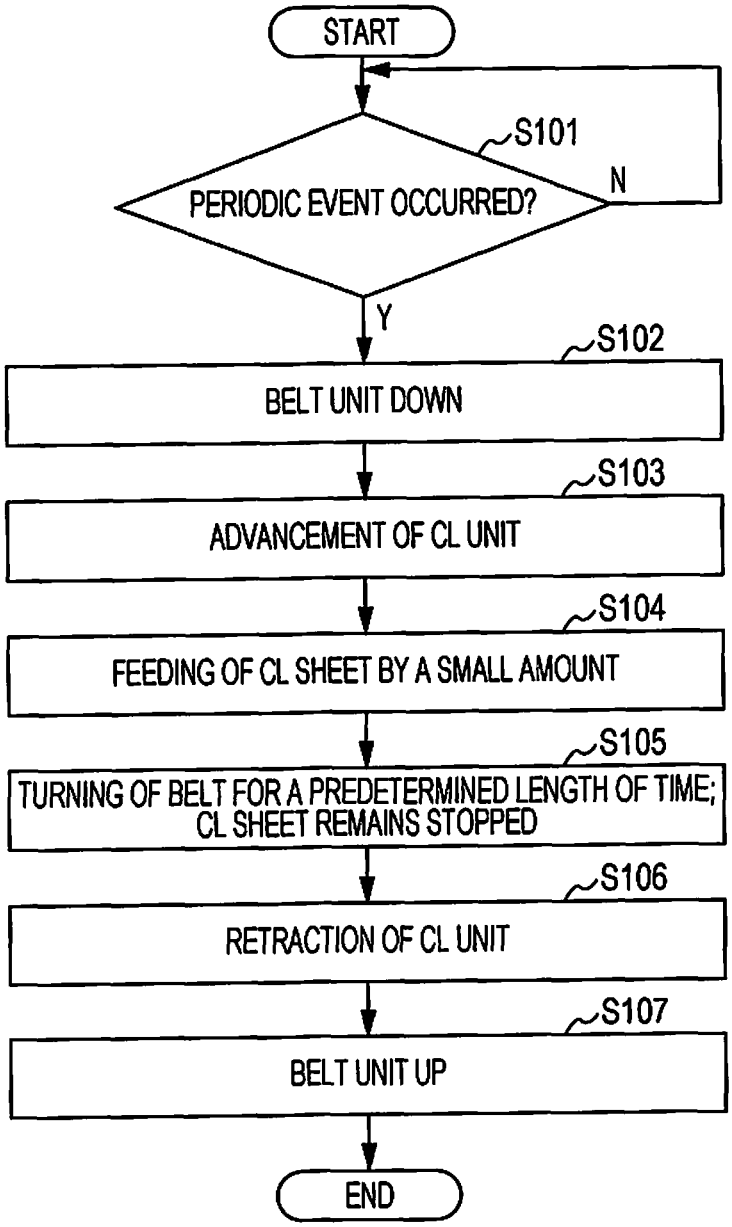
FIG. 11 is a flowchart that illustrates the content of control performed by a controller.
Figure 12:
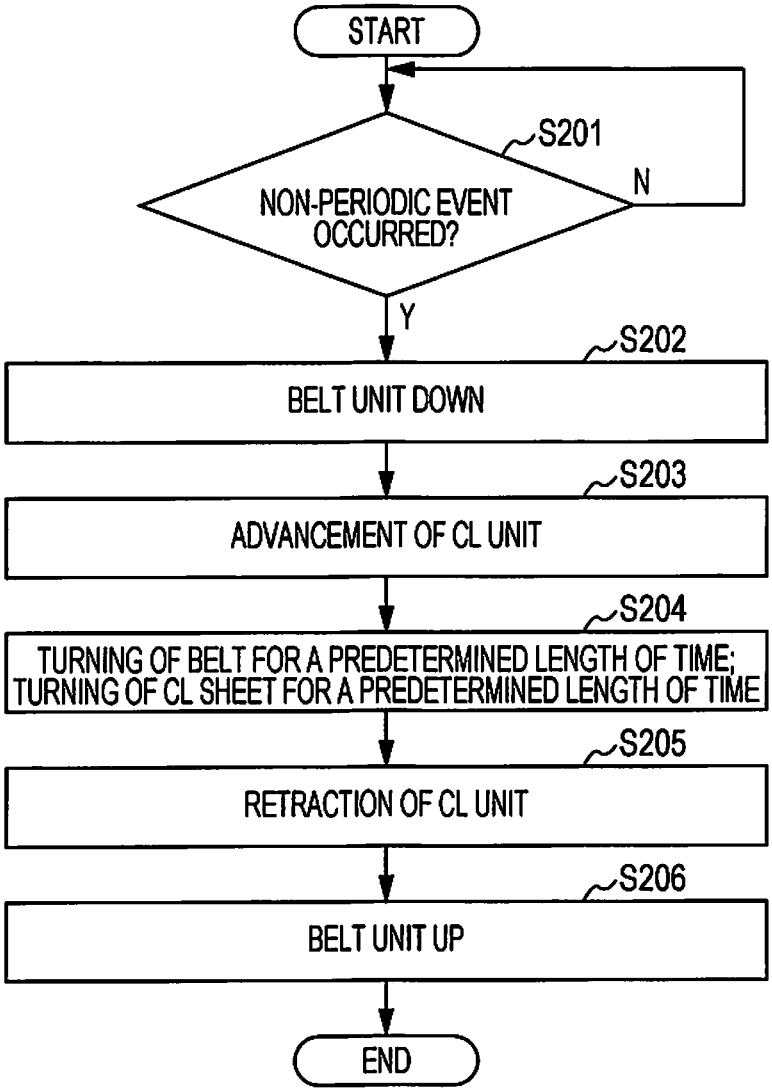
FIG. 12 is a flowchart that illustrates the content of control performed by the controller.

FIG. 1 is a perspective view of the appearance of an ink-jet printer 1, which is a "recording apparatus" according to an exemplary embodiment of the invention (hereinafter referred to as "printer"). FIG. 2 is a side sectional view of the paper transportation paths of the printer 1 substantially in their entirety. FIG. 3 is a side sectional view of some partial areas of the paper transportation paths of the printer 1. Each of FIGS. 4, 5, 6, 8, 9, and 10 is a side view of a belt unit 18 and a cleaning unit 50. FIG. 7 is an enlarged view of a contact portion 61. FIGS. 11 and 12 are flowcharts that illustrate the content of control performed by a controller 9.

Overall Structure of Printer

With reference to FIGS. 1 and 2, the overall structure of a printer 1 that performs ink-jet recording on recording paper, which is an example of a medium, will now be explained. In FIG. 1, the ink-jet printer 1 is equipped with a scanner unit 3 on the top of an apparatus body 2A, in which recording is performed on recording paper. Add-on units 2B and 2C are installed under the apparatus body 2A. The apparatus body 2A includes a paper cassette 10A. The add-on unit 2B includes a paper cassette 10B. The add-on unit 2C includes a paper cassette 10C. The add-on units 2B and 2C are optional units for increasing the number of sheets of paper that can be accommodated in the apparatus. The add-on units 2B and 2C are optionally attached to the apparatus body 2A.

The reference numeral 5 denotes an operation panel for various kinds of operation of the printer 1. The reference numeral 4 denotes a tray for receiving paper ejected after recording. More specifically, it is a face-down eject tray that receives paper with its recorded surface down, or with its last recorded surface down in a case of double-sided recording. The reference numeral 35 denotes a feeder unit that can be opened and closed with respect to the apparatus body 2A by being rotated on a fulcrum that is not illustrated.

The reference numeral 6 denotes an open/close cover that is a part of the feeder unit 35. The open/close cover 6 is pivotable on its pivot shaft 6*a* (FIG. 2). The reference numeral 41 (FIG. 2) denotes a manual feed tray that is configured to pivot together with the open/close cover 6. Pivotal movement on a pivot shaft 41*a* enables the manual feed tray 41 to be opened and closed. The manual feed tray 41 illustrated in FIG. 2 is in a housed position. A user opens the manual feed tray 41 in the clockwise direction from the state illustrated in FIG. 2 into an obliquely upward position, at which it is possible to feed sheets manually.

The portion where the operation panel 5 is provided is the front portion of the printer 1. The side where the open/close cover 6 is provided is the right side portion of the printer 1. That is, the feeding, transportation, and ejection of paper in the printer 1 are performed in the horizontal direction of the printer 1.

Next, with reference to FIG. 2, paper transportation paths in the printer 1 will now be explained. The printer 1 has three paper feed paths, which are: a feed path from the paper cassette 10A (see cassette feed trajectory line S1), a feed path from the paper cassette 10B, 10C that is not illustrated in FIG. 2 (see add-on cassette feed trajectory line S2), and a feed path from the manual feed tray 41 (see manual feed trajectory line S3), which is an example of a "medium placement section" on which, as a medium, sheets of paper are to be placed.

The printer 1 has two methods for ejecting paper. One of the two methods is face-up ejection, in which paper is ejected with its recorded surface up, or with its last recorded surface up in a case of double-sided recording (see face-up eject trajectory line T1). The other is face-down ejection, in which paper is ejected with its recorded surface down, or with its last recorded surface down in a case of double-sided recording (see face-down eject trajectory line T2).

In FIG. 2, the reference numeral 7 denotes a face-up eject tray for receiving paper with its face up. The face-up eject tray 7 is configured to be able to take two positional states by pivoting on its pivot shaft 7*a*, specifically, a housed state that is illustrated in FIG. 2 and an opened state that is not illustrated.

As described above, the printer 1 has five paper transportation paths, that is, a recording transportation path R1, which is an example of a first transportation path, a switchback path R2, which is an example of a second transportation path, a turnover path R3, which is an example of a third transportation path, a face-down eject path R4, which is an example of a fourth transportation path, and a face-up eject path R5, which is an example of a fifth transportation path.

In FIG. 2, the reference numeral 33 denotes a flap (path switching member) that is driven by a driving source that is not illustrated. The flap 33 is for switching between a state indicated by a solid line with the numeral 33 in FIG. 2 and a state indicated by a virtual line with the numeral 33' therein.

When the flap 33 is in the state indicated by the solid line in FIG. 2, recording paper is guided onto the face-down eject path R4 to be ejected with its face down as shown by the face-down eject trajectory line T2. When the flap 33 is in the state indicated by the virtual line 33' in FIG. 2, recording paper is guided onto the face-up eject path R5 to be ejected with its face up as shown by the face-up eject trajectory line T1.

In FIG. 2, the reference numeral 9 denotes a controller that performs various kinds of control processing. The controller 9 acquires recording data, which is data for performing recording. The recording data is generated either by a printer driver that runs on an external computer that is not illustrated or by the own printer driver of the controller 9. On the basis of the recording data, the controller 9 controls an ink-jet recording head (hereinafter referred to as "recording head") 8, various paper transportation rollers that are driven by motors that are not illustrated, path switching members (flaps), a belt unit 18 described later, and a cleaning unit 50 described later, etc. Moreover, the controller 9 performs necessary control on the basis of the detection state of various sensors (for example, a sensor that detects the passing of recording paper therethrough). In FIG. 2, the controller 9 is illustrated conceptually. Actually, the controller 9 is embodied as a circuit board that is provided at a predetermined position inside the apparatus body 2A. Next, the paper feed paths upstream of a pair of resist rollers 17 will now be explained with reference to FIG. 2.

The paper cassette 10A, which is detachably attached to the apparatus body 2A, is equipped with a hopper 11. The hopper 11 pivots on its shaft 11*a*. As a result of hopper operation, recording paper P accommodated in the paper cassette 10A comes into contact with, and away from, a feed roller 12, which is driven to rotate by a motor that is not illustrated.

The recording paper fed by the feed roller 12 from the paper cassette 10A is separated (prevention of feeding of two or more sheets at a time) by passing through a nip position formed by a pair of separation rollers 13. After that, the recording paper receives a forwarding force from a pair of transportation rollers 14 to arrive at the position of the pair of resist rollers 17. Each of the add-on units 2B and 2C (FIG. 1), which are located under the apparatus body 2A, is also provided with a feed roller 12 and a pair of separation rollers 13. The recording paper fed from each paper cassette receives a forwarding force from the pair of transportation rollers 14 illustrated in FIG. 2 to arrive at the position of the pair of resist rollers 17. The recording paper P fed from the manual feed tray 41 receives a forwarding force from a feed roller 15 to arrive at the position of the pair of resist rollers 17. The reference numeral 16 denotes a separation roller that co-operates with the feed roller 15 to nip the recording paper P therebetween for sheet separation.

Next, with reference to FIG. 3, the paper transportation paths downstream of the pair of resist rollers 17 will now be explained. In the following description referring to FIG. 3, it is assumed that recording paper is ejected via the face-down eject path R4 with its face down.

Rollers that are provided on the paper transportation paths will now be explained first. In FIG. 3, the reference numeral 17 denotes a pair of resist rollers, and each of the reference numerals 20 to 29 denotes a pair of transportation rollers that transport recording paper. One of the two rollers constituting each pair of transportation rollers 20 to 28 is denoted as F, and the other is denoted as G. The roller F is a driving roller that is driven by a motor that is not illustrated. For example, the roller F is constituted of a plurality of rubber-roller pieces arranged at appropriate intervals in the direction of the width of paper.

The roller G is a driven roller that is in contact with recording paper and rotates as a follower. The roller G is provided with one-to-one correspondence to the roller F, with its constituents arranged at appropriate intervals in the direction of the width of paper. The roller G is a serrated roller that has teeth on its perimeter. Because of such a serrated structure, the roller G is in point contact with a recording surface. The point contact prevents a white-patch missing-ink defect or an ink-transfer defect from occurring on the surface on which recording has already been performed (recorded surface). Besides those constituting the other in the respective pairs of transportation rollers, driven rollers G are provided at appropriate positions on the paper transportation paths, in particular, at the side that is to be in contact with the recorded surface.

The structure of the pair of resist rollers 17 and the pair of transportation rollers 29 is different from that of each pair of transportation rollers 20 to 28 described above. Specifically, the pair of resist rollers 17 includes a driving roller 17*a*, which rotates as a driver, and a driven roller 17*b*, which rotates as a follower. The driven roller 17*b* is a resin roller that has a smooth circumferential surface. Similarly, the pair of transportation rollers 29 includes a driving roller 29*a*, which rotates as a driver, and a driven roller 29*b*, which rotates as a follower. The driven roller 29*b* is a resin roller that has a smooth circumferential surface.

Between the rollers described above, recording paper is guided by upper and lower guide members. In FIGS. 2 and 3, for simplicity, reference numerals not are assigned to the guide members. The bold lines between the rollers represent the guide members. The illustration of the guide members is omitted in FIG. 4 and the subsequent drawings.

Next, the recording transportation path R1, which is an example of the first transportation path, will now be explained. The recording transportation path R1 includes an area under the recording head 8, which is an example of a recording section that performs recording on recording paper. The recording transportation path R1 leads from the upstream side to the downstream side through the area under the head. In the present embodiment, for convenience' sake, the recording transportation path R1 is roughly defined as a path region from a position M1 to a position M2 in FIG. 3. On the recording transportation path R1, recording paper receives a forwarding force from the pair of resist rollers 17 and the belt unit 18. The reference numerals 19*a* and 19*b* denote driven rollers that co-operate with a transportation belt 18*c*, which will be described later, to nip the recording paper P each therebetween.

In the present embodiment, the nozzles of the recording head 8 from which ink is ejected are arranged in such a way as to cover the entire area in the paper width direction (i.e., so-called line head). As such a line head, the recording head 8 is configured to be able to perform recording throughout the entire paper width without any movement in the paper width direction.

The switchback path R2, which is an example of the second transportation path, is a transportation path connected from the recording transportation path R1. Along the switchback path R2, the recording paper that has passed through the area under the recording head 8 is further forwarded (toward the left in FIG. 3), is switched back, and is thereafter transported in the direction that is the opposite (toward the right in FIG. 3) of the forwarding direction. The switchback path R2 is located at an inner curve position in relation to the face-down eject path R4, which will be described later. In the present embodiment, for convenience' sake, the switchback path R2 is roughly defined as a path region to the left of a position M3 in FIG. 3. On the switchback path R2, the recording paper receives a force from the pair of transportation rollers 26.

The turnover path R3, which is an example of the third transportation path, is a transportation path connected from the switchback path R2. The recording paper transported in the opposite direction (toward the right in FIG. 3) moves along the turnover path R3 over the recording head 8 in a bypassing manner to be turned over. The turnover path R3 merges with the recording transportation path R1 at a position upstream of the recording head 8 (in the present embodiment, at a position upstream of the pair of resist rollers 17). In the present embodiment, for convenience' sake, the turnover path R3 is roughly defined as a path region from the position M3 to a position M4 in FIG. 3. On the turnover path R3, the recording paper receives a force from the pair of transportation rollers 27, 28, 29.

The face-down eject path R4, which is an example of the fourth transportation path, is a transportation path connected from the recording transportation path R1. Along the face-down eject path R4, the recording paper that has passed through the area under the recording head 8 curves to be turned over in a state in which the surface that faced the recording head 8 is the inner surface. After the turnover, the recording paper is ejected from the face-down eject path R4. In the present embodiment, for convenience' sake, the face-down eject path R4 is roughly defined as a path region to the left of the position M2 in FIG. 3. On the face-down eject path R4, the recording paper receives a force from the pair of transportation rollers 20, 21, 22, 23, 24, 25.

A first flap 31 and a second flap 32 are provided at the junctions of the transportation paths. Each of the first flap 31 and the second flap 32 is an example of a path switching member for a transportation path switchover. The first flap 31 is pivotable on its fulcrum 31*a* by receiving a driving force from a driving means that is not illustrated. The second flap 32 is configured to be able to be in engagement with the first flap 31 via an engagement portion that is not illustrated. In accordance with the pivotal movement of the first flap 31, the second flap 32 pivots on its fulcrum 32*a*. The course of paper movement is set by means of these flaps.

Belt Cleaning

Figure 4:
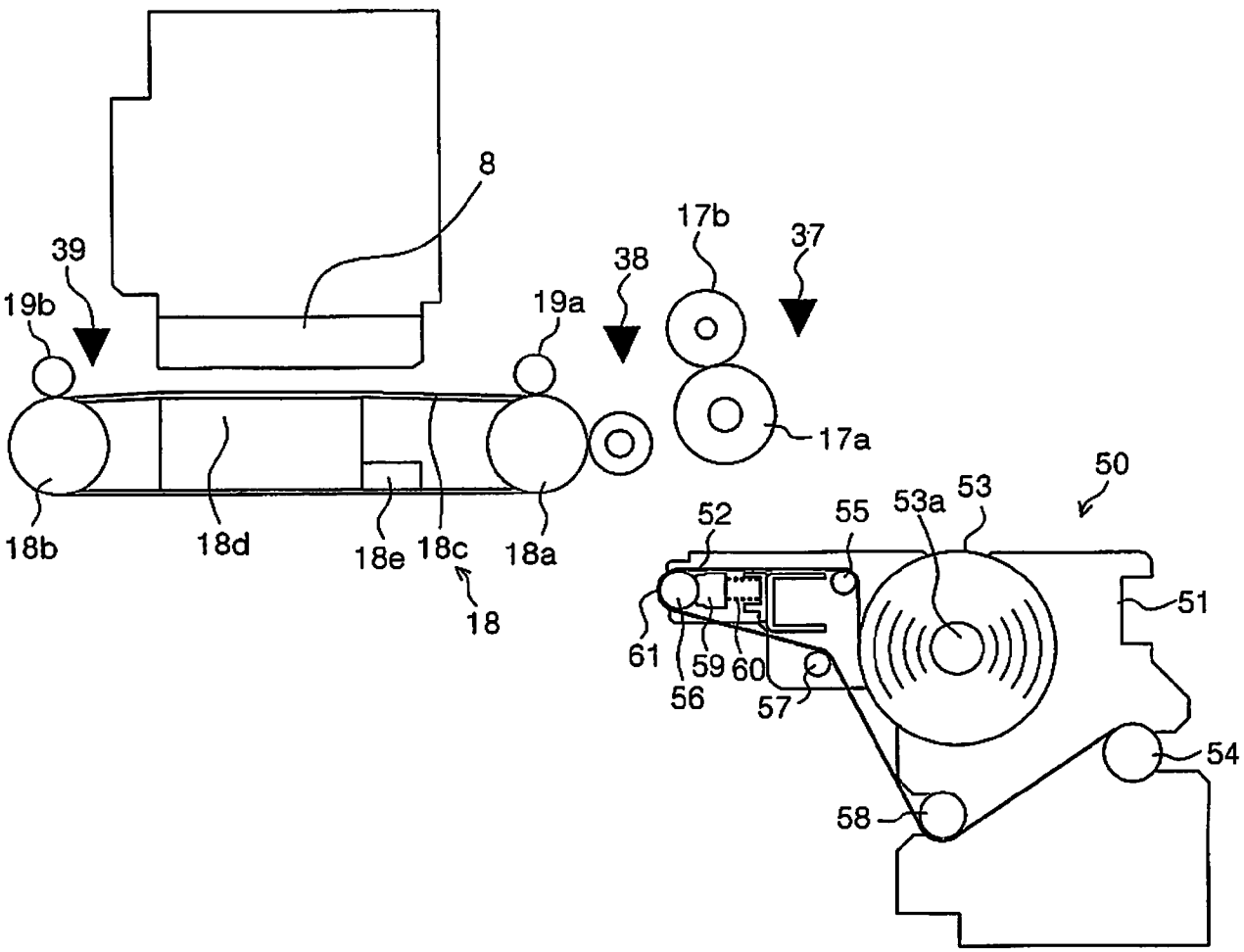
FIG. 4 is a side view of a belt unit and a cleaning unit.

Next, with reference to FIG. 4 and the subsequent drawings, the belt unit 18 and the cleaning (hereinafter abbreviated as "CL") unit 50 will now be explained. The belt unit 18 will now be explained first. In FIG. 4, the belt unit 18 includes a driving pulley 18*a*, a driven pulley 18*b*, and the transportation belt 18*c*. The driving pulley 18*a* is driven to rotate by a driving motor that is not illustrated. This motor is controlled by the controller 9 (FIG. 2). The transportation belt 18*c* is stretched between the driving pulley 18*a* and the driven pulley 18*b* and is driven due to the rotation of the driving pulley 18*a*. An example of the transportation belt 18*c* is an electrostatic adsorption belt.

The driven pulley 18*b* rotates as a follower when driven by the transportation belt 18*c*. Though the illustration of the detailed structure of the driven pulley 18*b* is omitted, the driven pulley 18*b* is configured to be able to change its position in a direction toward and away from the driving pulley 18*a* and is urged in the direction away from the driving pulley 18*a* by an urging means that is not illustrated. Because of this structure, the transportation belt 18*c* is in a tensioned state. The reference numeral 18*d* denotes a belt supporting portion configured to support the transportation belt 18*c* at the side facing the recording head 8. The reference numeral 18*e* denotes a belt supporting portion configured to support the transportation belt 18*c* at the side facing the contact portion 61 of the CL unit 50, which is an example of a cleaning section that will be described later.

The recording paper P coming from the pair of resist rollers 17 is transported toward the downstream side by the belt unit 18, which is located downstream thereof and has the structure described above, in a state of being electrostatically attracted to the transportation belt 18*c*, and recording is performed on the recording paper P by the recording head 8.

Figure 5:
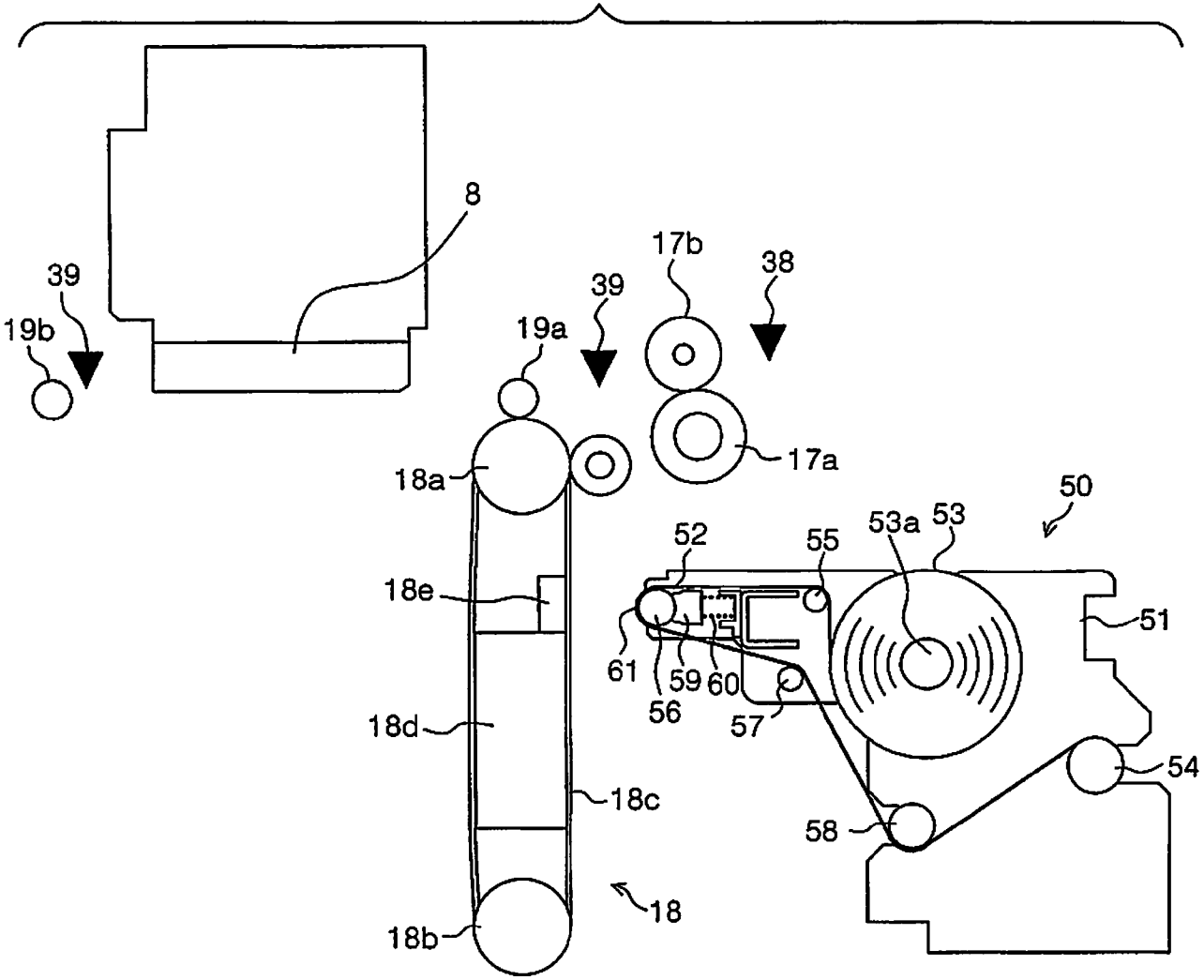
FIG. 5 is a side view of the belt unit and the cleaning unit.

The belt unit 18 is configured to be able to pivot on the rotation axis of the driving pulley 18*a*, as the center of pivotal movement, when driven by a driving mechanism that is not illustrated. Pivotal movement enables the belt unit 18 to switch between a head-facing state, in which the transportation belt 18*c* and the recording head 8 face each other as illustrated in FIG. 4, and a retracted state, in which the belt unit 18 in its entirety is away from the recording head 8 as illustrated in FIG. 5. The motive power for the pivotal movement of the belt unit 18 is supplied by the driving motor that is not illustrated and is controlled by the controller 9 (FIG. 2). When the belt unit 18 moves away from the recording head 8, a cap unit that is not illustrated moves toward the recording head 8 so as to be able to cap and seal the recording head 8. The detailed illustration and explanation of the capping structure is omitted.

Next, the CL unit 50 will now be explained. The CL unit 50 includes a unit body 51, a cleaning (CL) roll 53, a reeling roll 54, and driven pulleys 55 to 58. The CL roll 53 is a roll medium formed by wrapping a cleaning (CL) sheet 52 around a shaft 53*a*. The CL sheet 52 is reeled out from the CL roll 53 and is taken up by the reeling roll 54. In the present embodiment, the CL sheet 52 is a cloth. However, the CL sheet 52 is not limited to a cloth. Any alternative medium by means of which it is possible to clean the surface of the transportation belt 18*c* may be adopted instead. The cleaning of the transportation belt 18*c* by means of the CL sheet 52 may be either dry cleaning, in which cleaning liquid is not used, or wet cleaning, in which cleaning liquid is used.

The reeling roll 54 is driven to rotate by a driving motor that is not illustrated. This motor is controlled by the controller 9 (FIG. 2). During cleaning described later, the reeling roll 54 is driven to rotate in the clockwise direction in FIG. 4. The shaft 53*a* of the CL roll 53 may also be driven to rotate by the driving motor. In this case, during cleaning described later, the shaft 53*a* of the CL roll 53 is driven to rotate in the clockwise direction in FIG. 4. The CL sheet 52 reeled out from the CL roll 53 goes around the driven pulleys 55, 56, 57, and 58 to arrive at the reeling roll 54.

Among the plural driven pulleys, the driven pulley 56 is configured to be able to change its position in the horizontal direction in FIG. 4 and is urged toward the left in FIG. 4 by receiving an urging force of a spring 60 via an urging portion 59. The driven pulley 56 is a portion that holds the CL sheet 52 in contact with the transportation belt 18*c* for cleaning the surface of the belt unit 18 by means of the CL sheet 52. Therefore, preferably, the driven pulley 56 should be made of an elastic material such as rubber to ensure a sufficient area of contact of the CL sheet 52 with the transportation belt 18*c*.

The CL unit 50 in its entirety is configured to be able to change its position in the horizontal direction in FIG. 4 and is driven in the horizontal direction by a motor that is not illustrated. This motor is controlled by the controller 9 (FIG. 2).

Periodic (First) Cleaning Control

Next, control on the cleaning of the transportation belt 18*c* will now be explained in detail. To control the cleaning of the transportation belt 18*c*, the controller 9 (FIG. 2) is configured to be able to perform periodic cleaning control illustrated in FIG. 11, which is an example of "first cleaning control", and non-periodic cleaning control illustrated in FIG. 12, which is an example of "second cleaning control". First, periodic cleaning control illustrated in FIG. 11 will now be explained.

Periodic cleaning control illustrated in FIG. 11 can be executed upon the occurrence of, for example, the following event(s) (A1) to (A10):

(A1) Power ON;

(A2) Power OFF;

(A3) A print job has ended;

(A4) After the execution of the periodic cleaning last time, the number of times of job printing has reached a predetermined number of times;

(A5) After the execution of the periodic cleaning last time, the number of sheets printed has reached a predetermined number of sheets;

(A6) After the execution of the periodic cleaning last time, predetermined time has elapsed;

(A7) After the execution of the periodic cleaning last time, the amount of ink consumed has reached a predetermined amount;

(A8) In a single print job executed once, the number of sheets printed has reached a predetermined number of sheets;

(A9) In a single print job executed once, predetermined time has elapsed since the start of printing;

(A10) In a single print job executed once, the amount of ink consumed has reached a predetermined amount since the start of printing.

However, the events (A1) to (A10) described above are mere examples. Needless to say, periodic cleaning control may be executed upon the occurrence of other event, without limitation to those enumerated above. All of the events enumerated above may be set to trigger the execution of periodic cleaning control. Alternatively, any one event only among those enumerated above, or a combination of any of them, may be set to trigger the execution of periodic cleaning control. The conditions may be mixed arbitrarily; for example, periodic cleaning may be omitted in a case where, after the execution of periodic cleaning at the time of power on, printing has never been performed and the power is turned off in this state.

"Periodic event" illustrated in a step S101 of FIG. 11 means any of the events described above. For example, in a case where the number of sheets printed has reached a predetermined number of sheets (e.g., 2,000 sheets) after the execution of the periodic cleaning last time (A5), operation for periodic cleaning (defined as a step S105) is performed. For the periodic cleaning operation, first, the belt unit 18 is lowered as illustrated in FIG. 5 (step S102).

Next, the CL unit 50 is moved toward the belt unit 18 (step S103) to bring the contact portion 61 of the CL sheet 52, that is, the region of contact with the transportation belt 18*c*, into contact with the transportation belt 18*c*. The transportation belt 18*c* is in a stopped state. However, the contact portion 61 may be brought into contact with the transportation belt 18*c* in a state in which the transportation belt 18*c* is driven.

Figure 6:
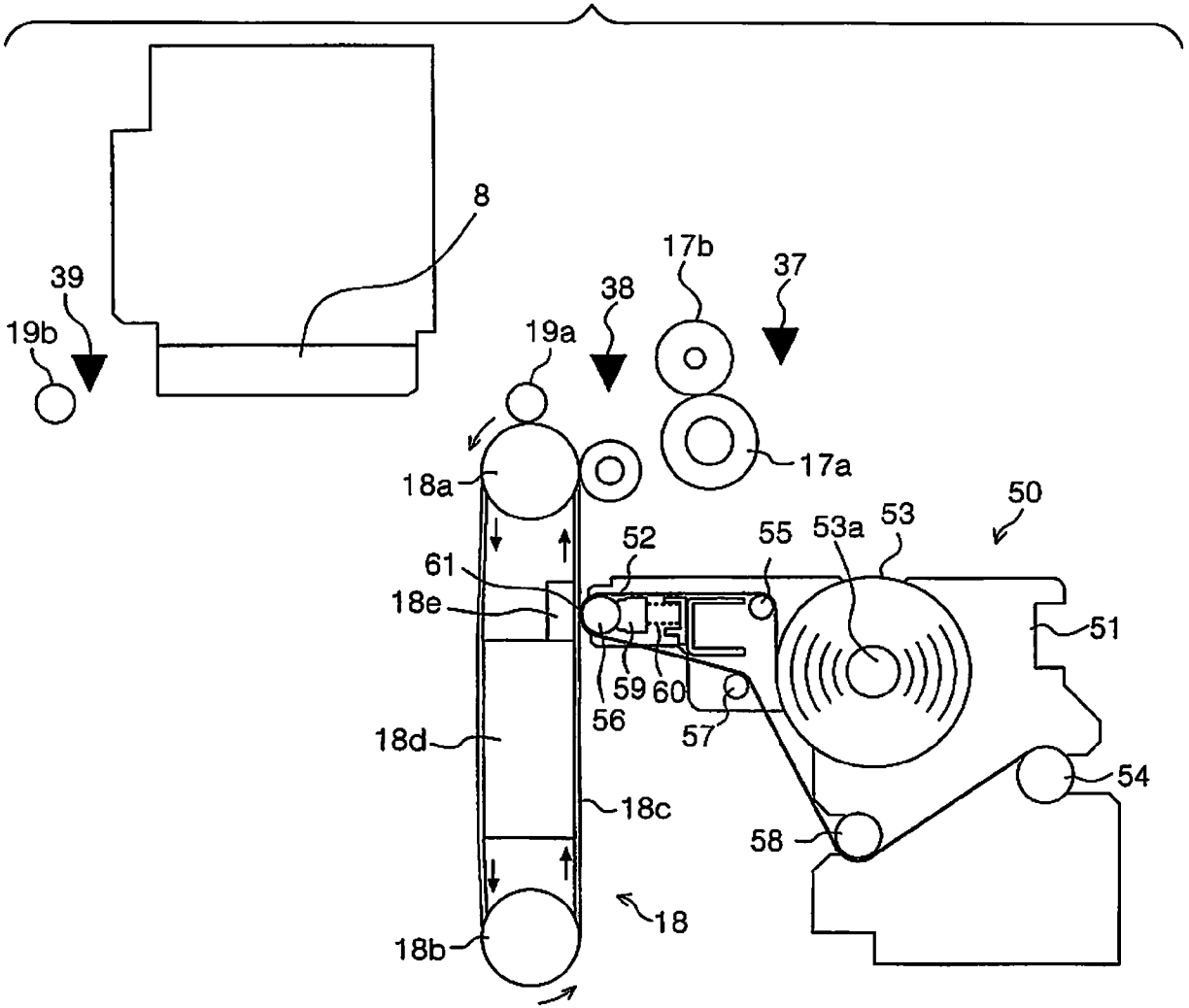
FIG. 6 is a side view of the belt unit and the cleaning unit.
Figure 7:
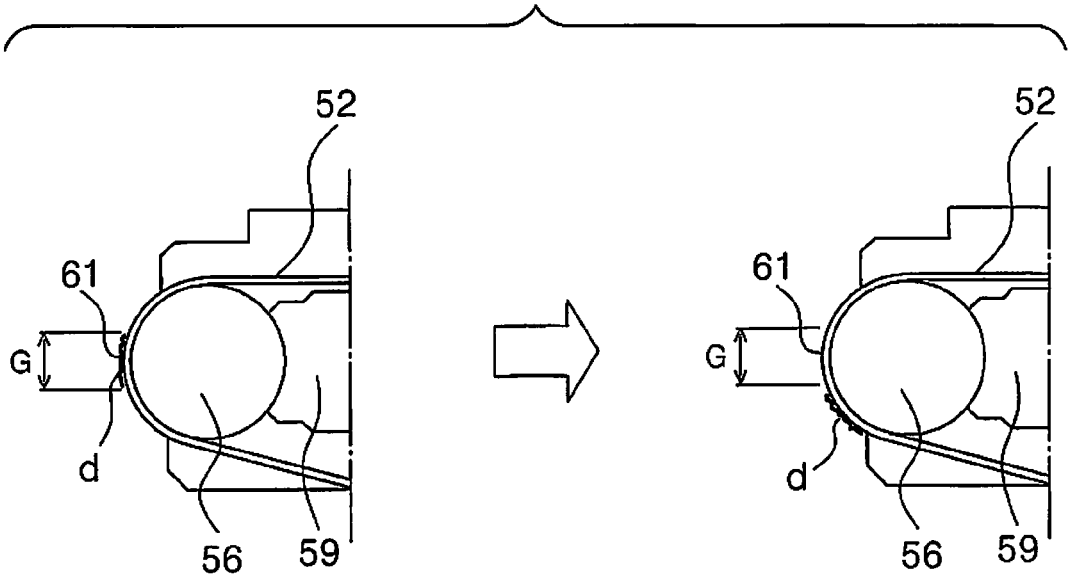
FIG. 7 is an enlarged view of a contact portion.
Figure 8:
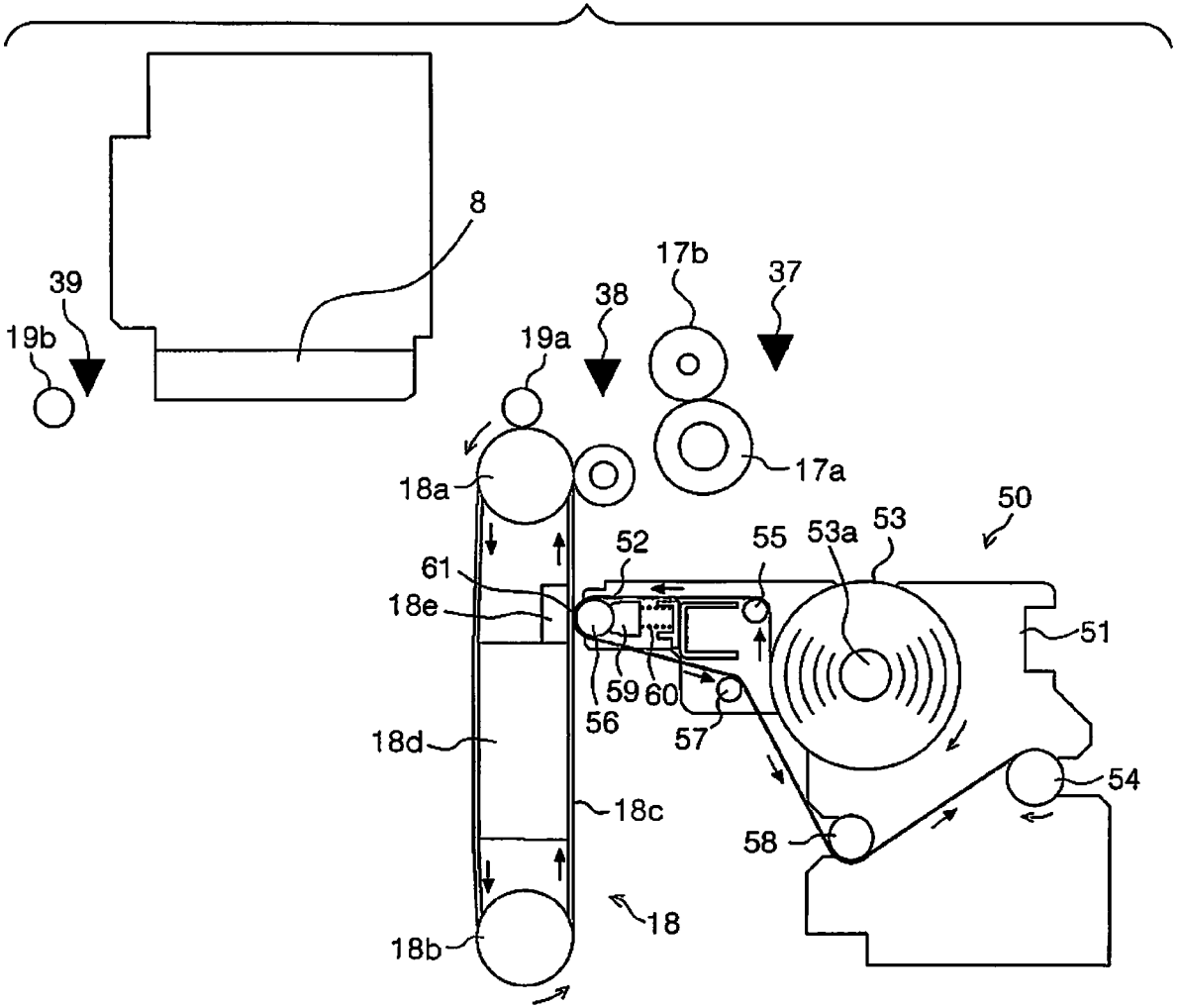
FIG. 8 is a side view of the belt unit and the cleaning unit.

At this time, the transportation belt 18*c* is in a state of being nipped between the CL sheet 52 and the belt supporting portion 18*e* (a state of being pressed due to the resilience of the spring 60) (FIG. 6). It is possible to adjust the force of nipping by adjusting the position of the CL unit 50. That is, if the CL unit 50 is brought closer to the belt unit 18, the contact portion 61 is in contact with the transportation belt 18*c* with a stronger force. The load of contact of the contact portion 61 with the transportation belt 18*c* is set to be, for example, 5N.

Next, the CL sheet 52 is fed by a small feed amount (step S104). At the point in time of the completion of the periodic cleaning last time (or at the point in time of the completion of non-periodic cleaning described later), the removed ink stain (and/or paper dust, fiber, etc.) d remains on the contact portion 61 as illustrated in the left part of FIG. 7. For the purpose of renewing the CL sheet 52 at the contact portion 61 from such a region that has already been used ("already-used" region) to a region that has not been used yet ("yet-to-be-used" region), the CL sheet 52 is fed by a small feed amount as illustrated in the right part of FIG. 7. Because of this sheet renewal, it can be expected that the results of cleaning that is going to be performed will be good. The range denoted as G in FIG. 7 is the range of the contact portion 61, that is, the range in which the CL sheet 52 is in contact with the transportation belt 18*c*.

Next, the transportation belt 18*c* is turned for a predetermined length of time in a state in which the CL sheet 52 is not driven and remains stopped, wherein the point in time of the contact of the contact portion 61 with the transportation belt 18*c* is taken as reference time (step S105). This operation is the cleaning of the transportation belt 18*c* (periodic cleaning operation). As indicated by arrows in FIG. 6, the turning direction of the transportation belt 18*c* in this operation corresponds to the turning direction for transporting the recording paper P toward the downstream side when the belt unit 18 is in the raised position. The turning time of the transportation belt 18*c* in this operation is set to be, for example, three minutes. Instead of specifying the speed of the turning, the number of turns may be specified (e.g., 40 turns). The moving speed of the transportation belt 18*c* in this operation is set to be, for example, 600 mm/sec.

The CL sheet 52 remains stopped when in this state, that is, during the periodic cleaning operation. Therefore, the renewal of the CL sheet 52 at the contact portion 61 from an already-used region to a yet-to-be-used region does not occur, meaning that the CL sheet 52 is not consumed. Since periodic cleaning control is executed in response to the occurrence of a periodic event that has been determined in advance, in many cases, ink on the transportation belt 18*c* is high in viscosity due to moisture evaporation. In such a case, it is possible to remove high-viscosity ink by means of only a part of the CL sheet 52 without rotation. Therefore, the renewal of the CL sheet 52 is skipped, which makes it possible to avoid wasteful consumption of the CL sheet 52.

Next, after the completion of the cleaning operation, the CL unit 50 is moved away from the transportation belt 18*c* (step S106), and the belt unit 18 is raised (step S107). The foregoing is an explanation of periodic cleaning control.

Non-Periodic (Second) Cleaning Control

Next, with reference to FIG. 12, non-periodic cleaning control will now be explained. Non-periodic cleaning control illustrated in FIG. 12 can be executed upon the occurrence of, for example, the following event(s) (B1) to (B3):

(B1) A paper jam has occurred;

(B2) Unexpected operation has been performed by a user during printing; for example, an open/close member such as a cover (e.g., the feeder unit 35 in FIG. 1) has been opened to expose a paper transportation path during printing, or any of the paper cassettes 10A, 10B, and 10C has been drawn out during printing;

(B3) Recovery after abnormal termination; for example, a power plug has been inserted after unplugging during printing.

However, the events (B1) to (B3) described above are mere examples. Needless to say, non-periodic cleaning control may be executed upon the occurrence of other event, without limitation to those enumerated above. All of the events enumerated above may be set to trigger the execution of non-periodic cleaning control. Alternatively, any one event only among those enumerated above, or a combination of any of them, may be set to trigger the execution of non-periodic cleaning control.

"Non-periodic event" illustrated in a step S201 of FIG. 12 means any of the events described above. For example, in a case where a paper jam has occurred (B1), operation for non-periodic cleaning (defined as a step S204) is performed. For example, in the present embodiment, the controller 9 (FIG. 2) detects a paper jam as follows. Each of inverted triangles 37, 38, and 39 in FIG. 4 is a simplified illustration of a sensor for detecting the passing of recording paper. The sensors 37, 38, and 39 may be non-contact-type (e.g., optical) sensors. Alternatively, they may be contact-type sensors.

For example, if the sensor 39 does not detect the passing of the leading edge of paper upon the lapse of expected time of arrival of the leading edge of the paper at the sensor 39 since the detection of the passing of the leading edge of the paper by the sensor 38, the controller 9 judges that a paper jam has occurred (the leading edge of the paper is located in a stopped state between the sensors 38 and 39), wherein the expected time of arrival is calculated on the basis of the transportation speed of the paper. Referring back to FIG. 12, non-periodic cleaning control, which is cleaning control executed upon the detection of the occurrence of a paper jam, etc. as described above, will now be further explained. First, the belt unit 18 is lowered as illustrated in FIG. 5 similarly to operation in the foregoing periodic cleaning control (step S202).

Next, the CL unit 50 is moved toward the belt unit 18 (step S203) to bring the contact portion 61 into contact with the transportation belt 18*c*. The transportation belt 18*c* is in a stopped state. However, the contact portion 61 may be brought into contact with the transportation belt 18*c* in a state in which the transportation belt 18*c* is driven. The load of contact of the contact portion 61 with the transportation belt 18*c* is set to be, for example, 5N as in the foregoing periodic cleaning control.

Next, unlike the foregoing periodic cleaning control, the CL sheet 52 is driven for a predetermined length of time wherein the point in time of the contact of the contact portion 61 with the transportation belt 18*c* is taken as reference time, and the transportation belt 18*c* is turned for a predetermined length of time wherein the point in time of the contact of the contact portion 61 with the transportation belt 18*c* is taken as reference time (step S204). This operation is the cleaning of the transportation belt 18*c* (non-periodic cleaning operation). As indicated by arrows in FIG. 8, the turning direction of the transportation belt 18*c* in this operation corresponds to the turning direction for transporting the recording paper P toward the downstream side when the belt unit 18 is in the raised position. The drive direction of the CL sheet 52 is the opposite of the moving direction of the transportation belt 18*c* at the contact portion 61. The turning time of the transportation belt 18*c* in this operation is set to be, for example, three minutes. Instead of specifying the speed of the turning, the number of turns may be specified (e.g., 40 turns). The moving speed of the transportation belt 18*c* in this operation is set to be, for example, 600 mm/sec. The drive speed of the CL sheet 52 is set to be, for example, 1 mm/sec. The drive amount of the CL sheet 52 is set to be, for example, 180 mm.

The drive time of the CL sheet 52 may be equal to the turning time of the transportation belt 18*c*. The drive time of the CL sheet 52 may be shorter than the turning time of the transportation belt 18*c*. The timing of the start of the driving of the CL sheet 52 after the contact of the contact portion 61 with the transportation belt 18*c* may be the same as the timing of the start of the turning of the transportation belt 18*c*. The timing of the start of the driving of the CL sheet 52 after the contact of the contact portion 61 with the transportation belt 18*c* may be after the timing of the start of the turning of the transportation belt 18*c*. Moreover, the timing of the start of the turning of the transportation belt 18*c* may be before, the same as, or after the timing of the contact of the contact portion 61 with the transportation belt 18*c*.

When in this state, that is, during non-periodic cleaning operation, in many cases, the time that has elapsed since the adhesion of ink onto the transportation belt 18*c* is short and, therefore, the viscosity of the ink is low. In such a case, it is possible to remove low-viscosity ink effectively by driving the CL sheet 52, that is, by performing continuous renewal operation of the CL sheet 52 at the contact portion 61 (renewal from an already-used region to a yet-to-be-used region (i.e., non-intermittent driving of the CL sheet 52)).

Next, after the completion of the cleaning operation, the CL unit 50 is moved away from the transportation belt 18*c* (step S205), and the belt unit 18 is raised (step S206). The foregoing is an explanation of non-periodic cleaning control.

The structure of the printer 1 according to the present embodiment described above can be summarized as follows. First, the printer 1 includes the recording head 8, which performs recording on recording paper P, and the transportation belt 18*c*, which transports the recording paper P to a recording area where the recording is performed by the recording head 8 (the area facing the recording head 8). The printer 1 further includes the CL unit 50, which is an example of a cleaning section, and the controller 9, which is an example of a control section. The CL unit 50 includes, as an example of a cleaning material, the CL sheet 52 for cleaning the transportation belt 18*c* by contact with the transportation belt 18*c*. The CL unit 50 is capable of switching between a contact state (FIG. 6), in which the CL sheet 52 is in contact with the transportation belt 18*c*, and a non-contact state (FIG. 5), in which the CL sheet 52 is not in contact with the transportation belt 18*c*. The CL unit 50 is capable of performing renewal operation, which is operation of renewing the region of contact with the transportation belt 18*c* at the contact portion 61 of the CL sheet 52 from a region that has already been used to a region that has not been used yet. The controller 9 controls the CL unit 50.

The controller 9 is capable of performing first cleaning control, in which the renewal operation is not performed during the cleaning of the transportation belt 18*c*, and second cleaning control, in which the renewal operation is performed during the cleaning of the transportation belt 18*c*. Therefore, in the first cleaning control, it is possible to avoid wasteful consumption of the CL sheet 52. In addition, it is possible to enhance the effects of cleaning the transportation belt 18*c* in the second cleaning control. That is, it is possible to reduce the consumption of the CL sheet 52, which is an example of a cleaning material, and extend product service life or reduce the frequency of the replacement of the CL sheet 52 by performing proper cleaning control corresponding to the state of the transportation belt 18*c*.

The controller 9 executes the first cleaning control in response to an event that occurs at timing that has been determined in advance and executes the second cleaning control in response to an event that occurs at non-periodic timing.

Ink on the transportation belt 18*c* after the lapse of time since the last cleaning is high in viscosity due to moisture evaporation in many cases. In such a case, that is, if a predetermined event has occurred, it is possible to remove high-viscosity ink by means of a part of the CL sheet 52. That is, it is possible to select the first cleaning control, thereby avoiding wasteful consumption of the CL sheet 52.

In contrast, if the time that has elapsed since the ejection of ink from the recording head 8 is short, that is, after an event that occurs non-periodically (e.g., paper jam), the viscosity of ink on the transportation belt 18*c* is low due to a small amount of moisture evaporation in many cases. In such a case, it is possible to remove low-viscosity ink effectively by selecting the second cleaning control.

In the present embodiment, the controller 9 selects the first cleaning control or the second cleaning control depending on an event that has occurred. Instead of such a configuration, for example, a user may select, via the operation panel 5 at arbitrary timing, whether the first cleaning control should be executed or the second cleaning control should be executed.

Before the execution of periodic cleaning control, which is an example of the first cleaning control, the controller 9 performs non-continuous renewal operation of the CL sheet 52 (feeding of the sheet by a small feed amount) as explained earlier in the step S104 of FIG. 11. Because of this small feed, in the CL sheet 52, the region of contact with the transportation belt 18*c* has been updated to a region that has not been used yet when periodic cleaning is performed. This ensures effective periodic cleaning. The non-continuous renewal operation of the CL sheet 52 (feeding of the sheet by a small feed amount) may be performed after the execution of periodic cleaning control instead of before the execution of periodic cleaning control. Alternatively, the sheet may be fed by a small feed amount both before and after the execution of periodic cleaning control.

The controller 9 may be configured to perform the renewal operation non-continuously before the execution of periodic cleaning control, which is an example of the first cleaning control, and not to perform the renewal operation before the execution of non-periodic cleaning control, which is an example of the second cleaning control. With this configuration, in the CL sheet 52, the region of contact with the transportation belt 18*c* has been updated to a region that has not been used yet when periodic cleaning is performed. Consequently, great cleaning effects can be expected in periodic cleaning control. Moreover, in a case of non-periodic cleaning control, the renewal operation is performed continuously during cleaning operation and, therefore, it is possible to avoid wasteful consumption of the CL sheet 52 by not performing unnecessary renewal operation before the execution.

In the present embodiment, the controller 9 executes non-periodic cleaning control, which is an example of the second cleaning control, upon detection of a paper jam. By removing ink on the transportation belt 18*c* immediately, it is possible to avoid the transfer of the ink onto the sheet of recording paper transported next.

The controller 9 may be configured to find an adhesion area where ink having been ejected from the recording head 8 has adhered onto the transportation belt 18*c* on a basis of paper jam detection information; and the renewal operation in non-periodic cleaning control, which is an example of the second cleaning control, may be performed from a state in which the CL sheet 52 is in contact either at a start position of the adhesion area or in front of the start position of the adhesion area. With reference to FIGS. 9 and 10, the modified control mentioned above will now be explained.

In FIG. 9, as described earlier, if the sensor 39 does not detect the passing of the leading edge of paper upon the lapse of predetermined time since the detection of the passing of the leading edge of the paper by the sensor 38, the controller 9 judges that a paper jam has occurred, and stops the driving of the transportation belt 18*c* immediately. The case where ink is ejected onto the widest surface area of the transportation belt 18*c* (the worst case) is a case where a paper jam occurs before the leading edge of paper arrives at the area facing the recording head 8 (recording area). The area denoted as W in FIG. 9 is an example of such a worst-case area on the transportation belt 18*c* onto which ink has been ejected.

FIG. 10 shows a state after the downward movement of the belt unit 18 from the state illustrated in FIG. 9. If the CL unit 50 is moved toward the belt unit 18 to bring the contact portion 61 into contact with the transportation belt 18*c* from the state illustrated in FIG. 10, the ink adhesion area W1 is located in front of the contact area, and the contact area is not so much stained. Therefore, if the renewal operation of the CL sheet 52 is performed immediately from this state, it will result in wasteful consumption of the CL sheet 52.

To avoid such wasteful consumption, the renewal operation is not performed until the start position S1 of the ink adhesion area W1 arrives at the contact portion 61. Specifically, the transportation belt 18*c* is turned until either the start position S1 or a position slightly in front of the start position S1 arrives at the contact portion 61 (by the distance W2); the operation of renewing the CL sheet 52 is initiated from this state.

By executing the control in this way, it is possible to avoid the CL sheet 52 from being renewed for an area that is not so much stained with ink on the transportation belt 18*c*, or to minimize the renewal operation, thereby avoiding wasteful consumption of the CL sheet 52.

In the present embodiment, the controller 9 sets contact pressure at which the CL sheet 52 is in contact with the transportation belt 18*c* in periodic cleaning control, which is an example of the first cleaning control, to be equal to contact pressure at which the CL sheet 52 is in contact with the transportation belt 18*c* in non-periodic cleaning control, which is an example of the second cleaning control (e.g., 5N). However, the contact pressure at which the CL sheet 52 is in contact with the transportation belt 18*c* in the periodic cleaning control may be set to be higher than the contact pressure at which the CL sheet 52 is in contact with the transportation belt 18*c* in the non-periodic cleaning control.

The higher contact pressure in the periodic cleaning control compensates for a decrease in cleaning performance due to the non-renewal of the CL sheet 52, thereby improving cleaning effects in the periodic cleaning operation.

In the present embodiment of the invention, the cleaning material for cleaning the transportation belt 18*c* is the CL sheet 52 that is in a form of a sheet roll (CL roll 53) and is reeled out from the sheet roll to be taken up onto a reeling shaft (reeling roll) 54; wherein, in the periodic cleaning control and the non-periodic cleaning control, the controller 9 drives the transportation belt 18*c*; and wherein the operation of renewing the CL sheet 52 is operation of rotating the CL roll 53. This makes it possible to perform the operation of renewing the cleaning material from a region that has already been used to a region that has not been used yet easily with a simple structure.

In the present embodiment, as the operation of renewing the CL sheet 52 in the non-periodic cleaning control, the controller 9 causes the CL sheet 52 to be moved in a direction that is opposite of a direction of movement of the transportation belt 18*c*. The movement of the CL sheet 52 in the opposite direction enhances cleaning effects in the non-periodic cleaning control. However, the direction of movement of the CL sheet 52 is not limited to the opposite direction. That is, the CL sheet 52 may be moved in the forward direction in relation to the direction of movement of the transportation belt 18*c*. In such a case, it is possible to clean the transportation belt 18*c* well by setting a difference between the moving speed of the transportation belt 18*c* and the moving speed of the CL sheet 52.

What is claimed is:

1. A recording apparatus, comprising:

a recording section that performs recording on a recording target medium;

a transportation belt that transports the recording target medium to a recording area where the recording is performed by the recording section;

a cleaning section that includes a cleaning material for cleaning the transportation belt by contact with the transportation belt and is capable of switching between a contact state, in which the cleaning material is in contact with the transportation belt, and a non-contact state, in which the cleaning material is not in contact with the transportation belt, and is capable of performing renewal operation, the renewal operation being operation of renewing a contact region of the cleaning material from a region that has already been used to a region that has not been used yet, the contact region being a region of contact with the transportation belt; and a control section that controls the cleaning section, wherein the control section is capable of performing first cleaning control, in which the renewal operation is not performed during the cleaning of the transportation belt, and second cleaning control, in which the renewal operation is performed during the cleaning of the transportation belt.

2. The recording apparatus according to claim 1, wherein the control section executes the first cleaning control in response to an event that occurs at timing that has been determined in advance and executes the second cleaning control in response to an event that occurs at non-periodic timing.

3. The recording apparatus according to claim 2, wherein the control section performs the renewal operation either before or after, or both, the execution of the first cleaning control.

4. The recording apparatus according to claim 3, wherein the control section executes the second cleaning control upon detection of a jam of the medium.

5. The recording apparatus according to claim 4, wherein the control section finds an adhesion area where liquid having been ejected from the recording section has adhered onto the transportation belt on a basis of medium jam detection information; and wherein the renewal operation in the second cleaning control is performed from a state in which the cleaning material is in contact either at a start position of the adhesion area or in front of the start position of the adhesion area.

6. The recording apparatus according to claim 5, wherein the control section sets contact pressure at which the cleaning material is in contact with the transportation belt in the first cleaning control to be higher than contact pressure at which the cleaning material is in contact with the transportation belt in the second cleaning control.

7. The recording apparatus according to claim 2, wherein the cleaning material is a cleaning sheet that is in a form of a sheet roll and is reeled out from the sheet roll to be taken up onto a reeling shaft;

wherein, in the first cleaning control and the second cleaning control, the control section drives the transportation belt; and wherein the operation of renewing the cleaning material is operation of rotating the sheet roll.

8. The recording apparatus according to claim 7, wherein, as the operation of renewing the cleaning material in the second cleaning control, the control section causes the cleaning sheet to be moved in a direction that is opposite of a direction of movement of the transportation belt.

9. The recording apparatus according to claim 2, wherein the control section performs the renewal operation after selection of the first cleaning control and before the execution of the first cleaning control and does not perform the renewal operation after selection of the second cleaning control and before the execution of the second cleaning control.

10. The recording apparatus according to claim 1, wherein the cleaning of the transportation belt is performed by rotating the transportation belt, and wherein the renewal operation is operation of renewing a contact region of the cleaning material from a region that has already been used to a region that has not been used yet by rotating the cleaning material.

* * * * *